US005435858A

United States Patent [19]

Takamura et al.

[11] Patent Number: 5,435,858

[45] Date of Patent: Jul. 25, 1995

[54] METHOD FOR TIG WELDING 1.25 CR-0.5MO STEEL PIPE FOR WHICH PREHEATING AND POSTHEATING TREATMENTS CAN BE EFFECTIVELY OMITTED

[75] Inventors: Toshihiro Takamura; Yukio Nishino; Kozo Teraoka; Motoaki Oyama, all of Tokyo; Koji Akiyama; Takero Arima, both of Yokohama, all of Japan

[73] Assignee: NKK Corporation, Tokyo, Japan

[21] Appl. No.: 984,865

[22] Filed: Dec. 1, 1992

[51] Int. Cl.[6] ..... C22C 38/22; B23K 11/00

[52] U.S. Cl. ..... 219/137 R; 138/DIG. 6; 219/74; 219/59.1; 148/909

[58] Field of Search ..... 420/105; 148/909; 138/177, DIG. 6; 219/74, 59.1

[56] References Cited

U.S. PATENT DOCUMENTS 4,529,454 6/1985 Hataya et al. ..... 148/36
5,213,633 5/1993 Hada et al. ..... 148/909

FOREIGN PATENT DOCUMENTS 57-143466 9/1982 Japan ..... C22C 38/46
61-056309 12/1986 Japan ..... C22C 38/46

OTHER PUBLICATIONS

T. Matsumoto et al "Reduction of Carbon Content and Provemention of Weld Cracking in 1¼Cr-½Mo Steel; Quarterly Journal of the Japan Welding Society" vol. 3 (1985), No. 2, pp. 135-143; and its partial English language translation.

Japanese High Pressure Institute "(Nongovenmental) Standard HPIS E-111-1981" pp. 128-137; and its partial English language translation.

NKK Corp. "NKK Technical Material STPA23WEL" Dec. 1991; and its entire English language translation.

*Primary Examiner*—Deborah Yee

*Attorney, Agent, or Firm*—Frishauf, Holtz, Goodman & Woodward

[57] ABSTRACT

This invention is of a Cr—Mo steel pipe of a wall thickness of 13 mm or less, containing C: 0.03-0.10 wt %, Si: 0.50-1.00 wt %, Mn: 0.30-0.60 wt %, P≦0.007 wt %, S≦0.020 wt %, Cr: 1.00-1.50 wt %, Mo: 0.45-0.65 wt %, Al: 0.002-0.010 wt % and N: 0.002-0.010 wt % and the remainder consisting of Fe and unavoidable impurities for which preheating and postheating treatments for the prevention of weld cracking and stress corrosion cracking can be effectively omitted, said steel pipe of this invention being suitable for steam piping applications such as STPA23 used in power generation plants, etc.

8 Claims, 6 Drawing Sheets

METHOD FOR TIG WELDING 1.25 CR-0.5MO STEEL PIPE FOR WHICH PREHEATING AND POSTHEATING TREATMENTS CAN BE EFFECTIVELY OMITTED

BACKGROUND OF THE INVENTION

1. Field of the Invention

This invention relates to a Cr—Mo steel for which preheating and postheating treatments can be effectively omitted, and a welding method thereof, wherein said steel pipe is for application as steam piping in power generation plants etc. such as steam piping made of STPA23, as well as to on-site welding of such pipes.

2. Description of the Prior Art

In general, 1.25Cr-0.5Mo steel pipes such as STPA23 possess extremely high hardness at welding and it has thus been necessary to apply preheating and postheating treatments in order to reduce the hardness as well as prevent low temperature cracking during welding and avoid stress corrosion cracking during use of the piping. This means that a preheating treatment is necessary to prevent the occurrence of weld cracking and, on the other hand, if said steel pipes are left welded as they are, the absorbed energy at Charpy impact testing under room temperature remains at 2 to 7 kg-m and it becomes indispensable to improve it to around 10 to 15 kg-m by applying a postheating treatment at 550° to 700° C.

Various efforts have since been exerted to solve this problem and, for example, on page 371 of No. 2, Vol. III of The Collection of Papers of the Welding Society issued in 1985 a description is given on shielded arc-welding of a steel plate containing C, Cu, Ni, Cr and Mo within a specific range, said steel plate being first preheated to a temperature of 100° C. or less to eliminate the necessity for a postheating treatment, and on multi-layer SAW welding after preheating to a temperature of 225° C. or above, also maintaining the interpass temperature at 225° C. or above, to eliminate the need for a postheating treatment. A similar description can be found in JP,B 61-56309.

Also, in HPIS, stress annealing criterion and explanation thereof, it is stated that when steel materials of the standard composition of SCMV3, STPA23 or STBA23 are preheated to a temperature of 150° C. to 300° C. and if the interpass temperature is maintained at 150° C. to 300° C., a postheating treatment can be omitted. A similar description can be found in JP,B 61-56309.

With a 1.25Cr-0.5Mo steel material, the thermally influenced section undergoes extreme hardening during welding and tends to cause low temperature weld cracking. In order to prevent this, it is necessary to apply a preheating treatment at 200° C. to 350° C. to lessen the degree of hardening of the thermally influenced section during welding and, also, to reduce the content of diffused hydrogen which leads to the occurrence of cracking. In many cases, it becomes necessary to apply a postheating treatment at 620° C. to 700° C., in order to soften the thermally influenced section during welding, to eliminate or reduce residue hydrogen, to restore toughness and to prevent stress corrosion cracking. However, application of such treatments is very troublesome and disadvantageous in terms of cost and delivery leadtime and it is evident that execution thereof has an adverse effect on product quality.

SUMMARY OF THE INVENTION

The inventors of the present invention carried out repeated studies in an attempt to solve the technical problems associated with conventional steel materials as aforementioned and succeeded in effectively omitting both preheating and postheating treatments by applying TIG welding between two units of a certain composition of steel pipe or between a steel pipe and a steel pipe coupling without said preheating and postheating treatments, said steel pipe or steel pipe coupling being made of 1.25Cr-0.5Mo steel with compositions of C: 0.03–0.10 wt %, Si: 0.50–1.00 wt %, Mn: 0.30–0.60 wt %, P≦0.020 wt %, S≦0.007 wt %, Cr: 1.00–1.50 wt %, Mo: 0.45–0.65 wt %, Al: 0.002–0.010 wt %, N: 0.002–0.010 wt % and the remainder consisting of Fe and unavoidable impurities, and the wall thickness of said steel pipe being 13 mm or less.

DESCRIPTION OF THE PREFERRED EMBODIMENT

The reasons for liming the range of contents of the aforementioned components of the present invention are as explained below using wt % (hereafter called %) ratios.

C: 0.03–0.10%

C is the element which exerts the largest influence on hardening of the welded section, which in turn influences the occurrence of low temperature cracking. Consequently, the upper limit is set at 0.10% to prevent cracking and to decrease hardness and the lower limit is set at 0.03% to secure material strength.

Si: 0.50–1.0%

A content of 0.50% or more is needed as a deoxidizer but the upper limit is set at 1.00% to maintain toughness.

Mn: 0.30–0.60%

The content is limited to a range of 0.30–0.60% in order to secure strength under room temperature.

P: 0.020% or less

In order to improve the impact characteristics, impurity element P is reduced to 0.020% or less.

S: 0.007% or less

It is important to limit the S content to 0.007% or less in order to obtain high toughness for a welded coupling without the postheating treatment.

Cr: 1.00–1.50%

It is necessary to maintain the Cr content at 1.00–1.50% to secure the necessary corrosion resistance and appropriate high temperature strength.

Steel pipes of the present invention possessing the aforementioned component amounts should have a wall thickness of 13 mm or less. This means that when performing welding, the thicker the wall thickness, the faster the cooling speed after welding and the greater the hardness of the welded section and it is consequently necessary to limit the wall thickness of the pipes to 13 mm or less to obtain the specified hardness of Hv250 or less.

Also, weld cracking is usually caused by reaction stress which occurs at welding and the extent of such force of constraint is proportional to the wall thickness of the coupling. Consequently, it is necessary to limit the wall thickness to 13 mm or less in order to prevent the occurrence of excessive reaction stress in the coupling section. Furthermore, with this invention, the TIG welding method is employed to avoid mixing in hydrogen with the deposited metal.

This invention calls for the aforementioned compositions amounts, especially, substantially reducing the P and S contents, as well as decreasing the C content, while limiting the wall thickness to 13 mm or less and adopting the TIG welding method, thus enabling effective welding free from requirements of preheating or postheating treatment, for more convenient and advantageous on-site welding.

Figure 1:
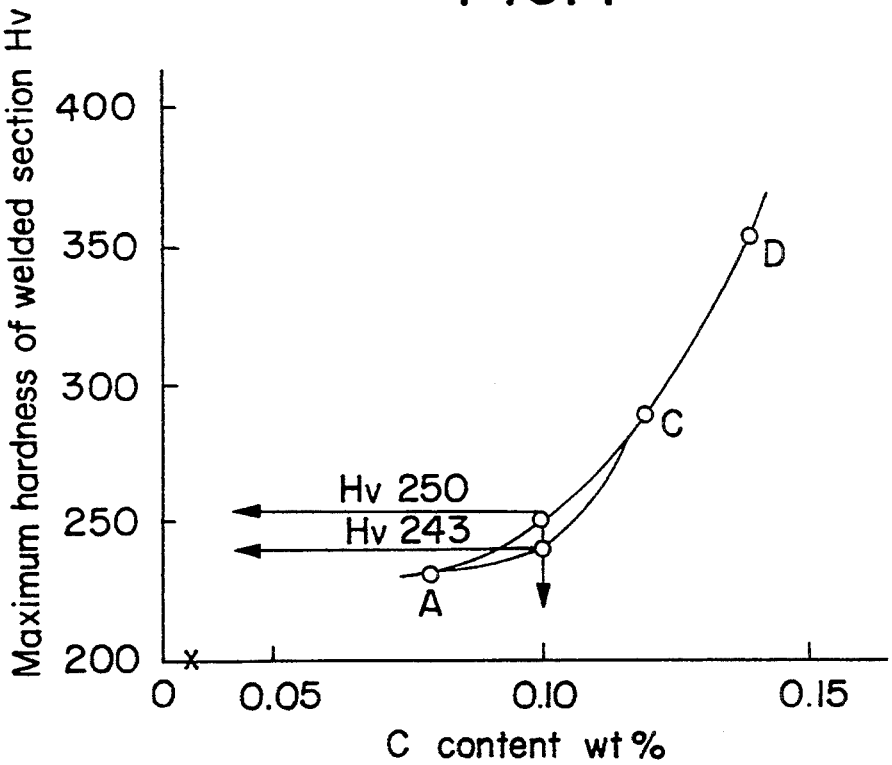
FIG. 1 is a graph indicating the relation between the maximum hardness of the welded section and the content of Co.

Referring more particularly to the details of the technical aspects of the present invention, the relation between the maximum hardness of the welded section and the C content is indicated in FIG. 1 wherein the results of TIG multi-layer welding, under the respective current and voltage of 120±10 A and 13±5 V, of 250 A×12.7 t steel pipe samples A through D of the chemical compositions as given in Table 1 below using a welding rod with a composition of 0.02 C, 0.48 Si, 1.10 Mn, 1.03 Cr and 0.5 Mo and under shielding using Ar gas.

TABLE 1

| Steel pipe | C | Si | Mn | P | S | Cr | Mo (%) |
|---|---|---|---|---|---|---|---|
| A | 0.08 | 0.70 | 0.40 | 0.013 | 0.006 | 1.23 | 0.48 |
| B | 0.10 | 0.73 | 0.48 | 0.011 | 0.004 | 1.28 | 0.52 |
| C | 0.12 | 0.75 | 0.51 | 0.016 | 0.006 | 1.31 | 0.55 |
| D | 0.14 | 0.75 | 0.60 | 0.015 | 0.005 | 1.37 | 0.51 |

The graph of FIG. 1 clearly indicates that a maximum hardness of Hv250 or less can be properly obtained at a C content of 0.10% or less.

Figure 2:
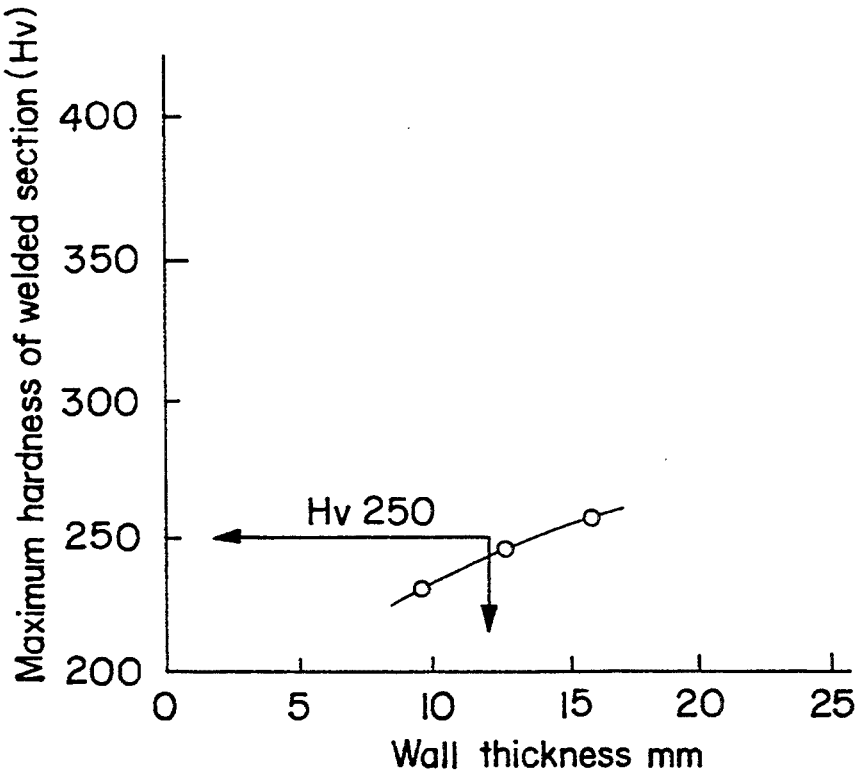
FIG. 2 is a graph indication of the relation between maximum hardness and wall thickness of the pipe.

FIG. 2 shows the relation between the maximum hardness of the welded section and the wall thickness of the pipe. Here, pipes of 250 A×9.5 t, 12.7 t and 15.9 t having the same composition as type B in the above Table 1 are multi-layer TIG welded under the same current and voltage, shielding gas and welding rod as in the aforementioned test and a hardness of 250 Hv or less can be maintained with pipes of a wall thickness of 13 mm or less, especially with a wall thickness of 12 mm or less.

Figure 3:
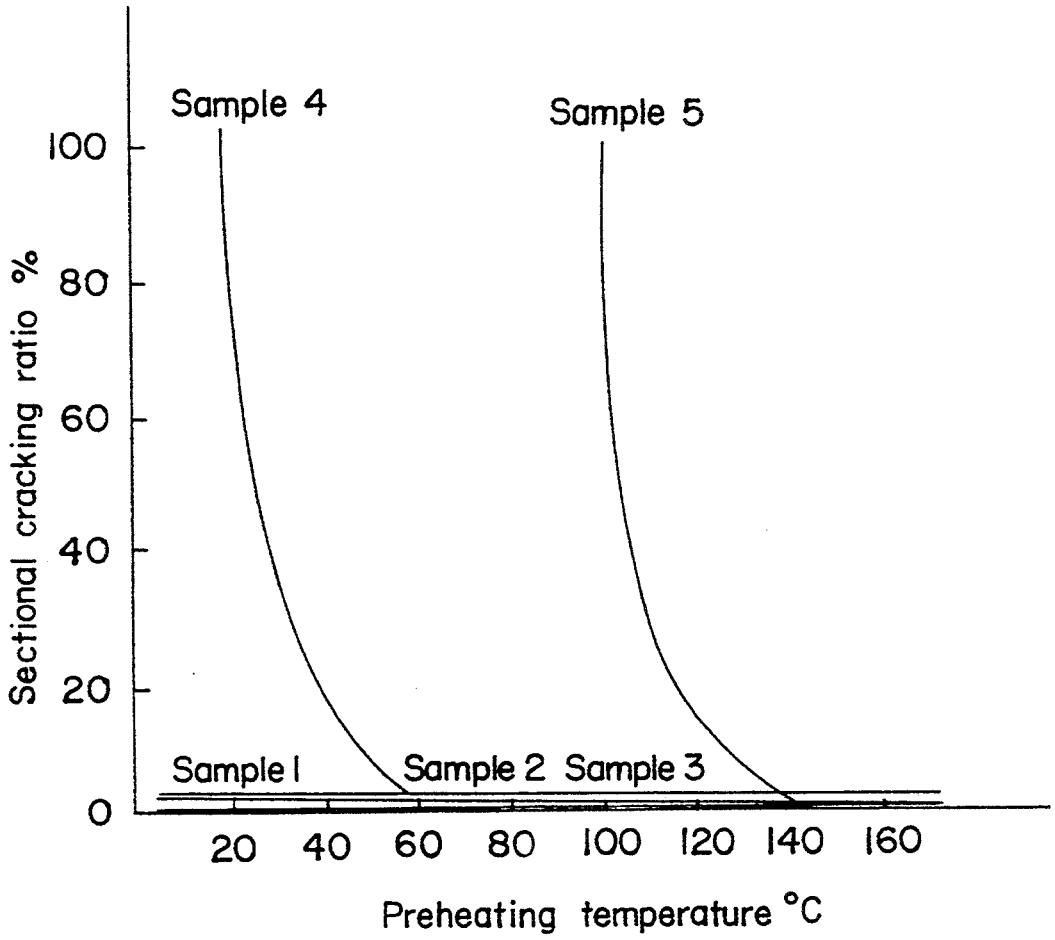
FIG. 3 is a graph indicating the result of the y constraint cracking test performed to check the relation between weld cracking and welding method.

Referring to the relation between weld cracking and the welding method, FIG. 3 indicates the results of y constraint cracking testing. Samples of sample numbers 1 though 5 in Table 2 were TIG welded or SMAW welded, and the results can be summarized below.

<1> With a 0.14% C test sample of 25 mm thickness, for the SMAW method welding, preheating to 140° C. is necessary to prevent cracking.

<2> With a 0.14% C test sample of 12 mm thickness, the necessary preheating temperature for the SMAW method welding decreases to 60° C. indicating the effect of the lowered restraint. With a 0.14% C test sample, the preheating temperature further drops to 50° C.

<3> With a 0.08% C test sample of 12 mm thickness, cracking does not occur by SMAW method welding even if preheating is omitted.

<4> With TIG method welding, cracking does not occur with either the 0.14% C sample or 0.08% C sample of 12 mm thickness because the hydrogen content, which causes cracking, is drastically suppressed.

TABLE 2

| No | Composition (%) C | Si | Mn | Cr | Mo | Wall thickness | Welding method |
|---|---|---|---|---|---|---|---|
| 1 | 0.08 | 0.70 | 0.40 | 1.23 | 0.48 | 12 mm | TIG |
| 2 | 0.08 | 0.70 | 0.40 | 1.23 | 0.48 | 12 mm | SMAW |
| 3 | 0.12 | 0.72 | 0.40 | 1.25 | 0.49 | 12 mm | TIG |
| 4 | 0.12 | 0.72 | 0.40 | 1.25 | 0.49 | 12 mm | SMAW |
| 5 | 0.14 | 0.75 | 0.60 | 1.37 | 0.51 | 12 mm | TIG |
| 6 | 0.14 | 0.75 | 0.60 | 1.37 | 0.51 | 12 mm | SMAW |
| 7 | 0.14 | 0.75 | 0.60 | 1.37 | 0.51 | 25 mm | SMAW |

Thus, with TIG welding, a combination of a carbon content of 0.10% or less and a wall thickness of 12 mm or less provides a welded piping which is fully resistant to weld cracking.

Figure 4A:
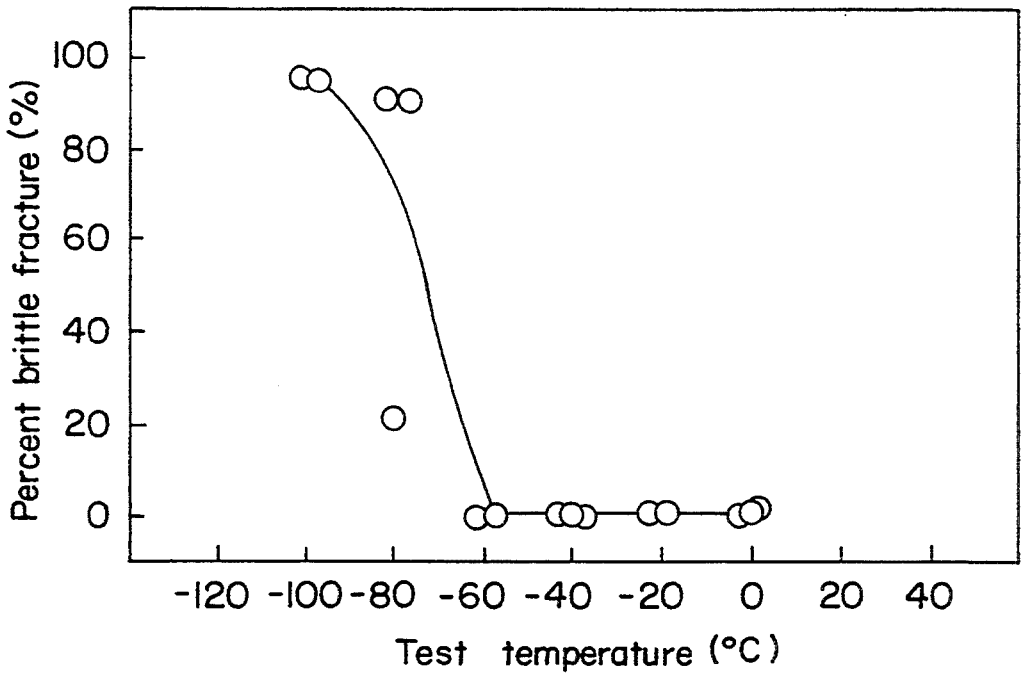
FIG. 4 is a graph indicating the strength and results of the toughness test carried out on the steel pipe of the composition of the present invention.
Figure 4B:
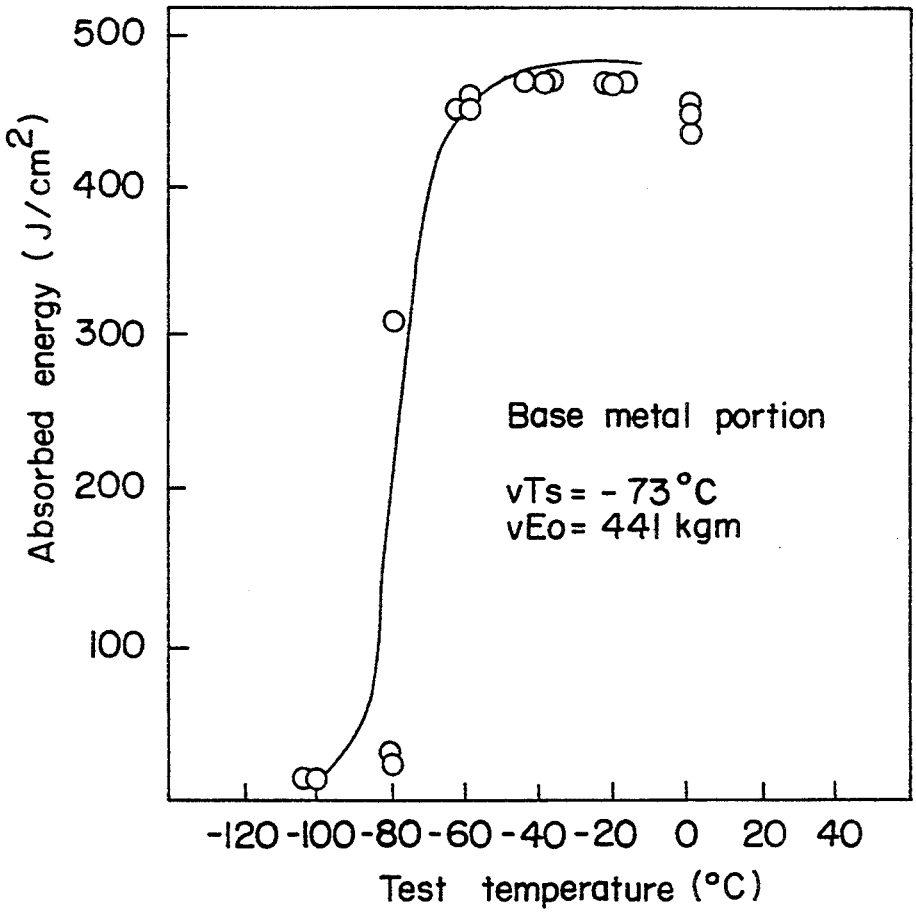
Figure 7A:
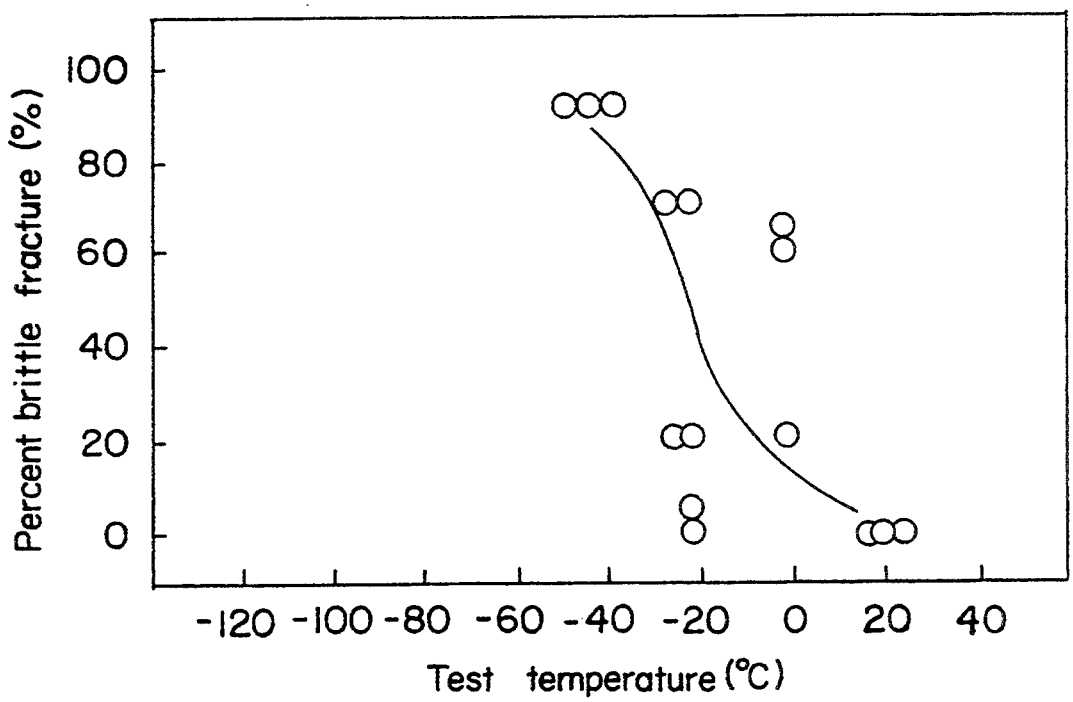
FIG. 7 is a graph indicating the impact test results of the welded coupling of this invention.
Figure 7B:
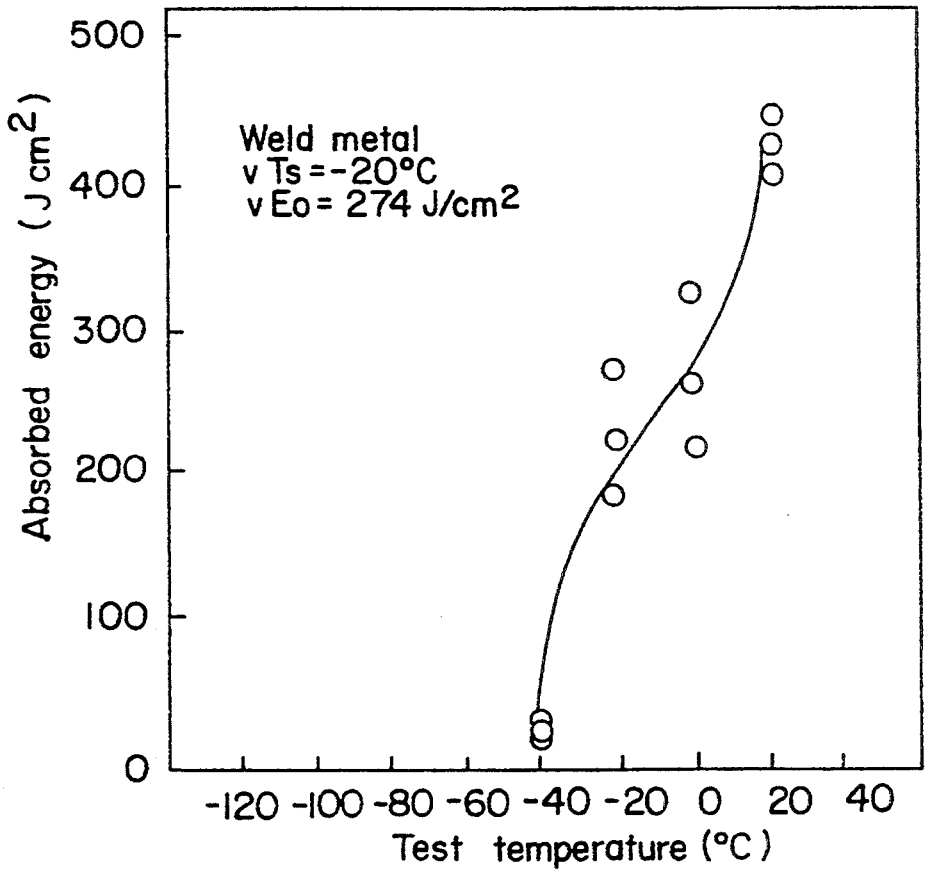
Figure 7C:
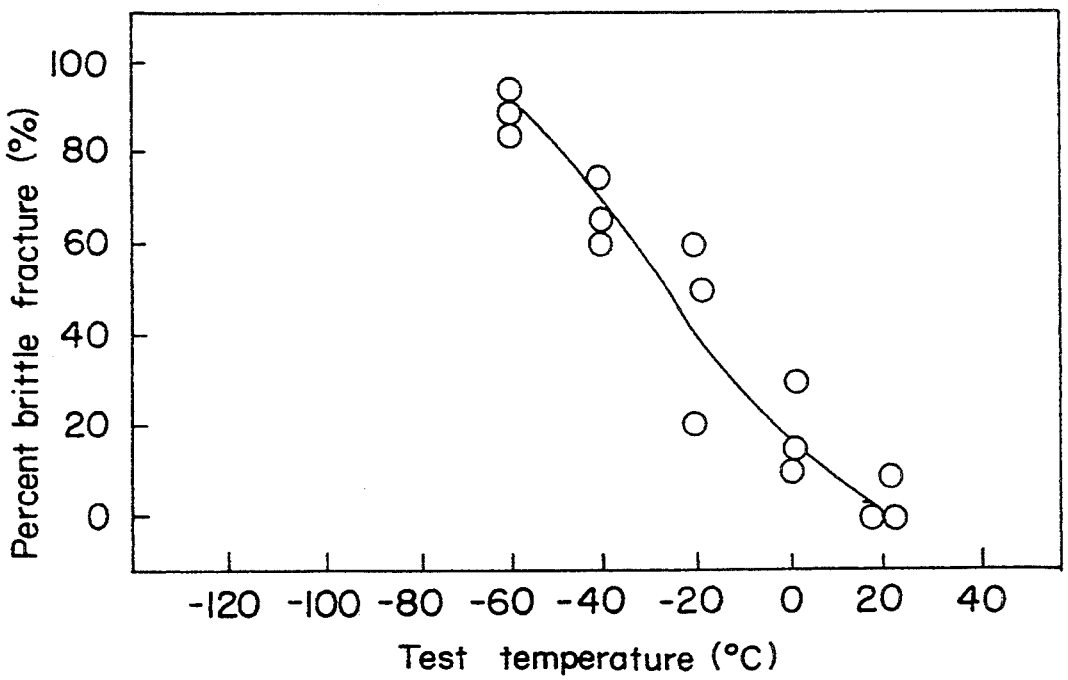
Figure 7D:
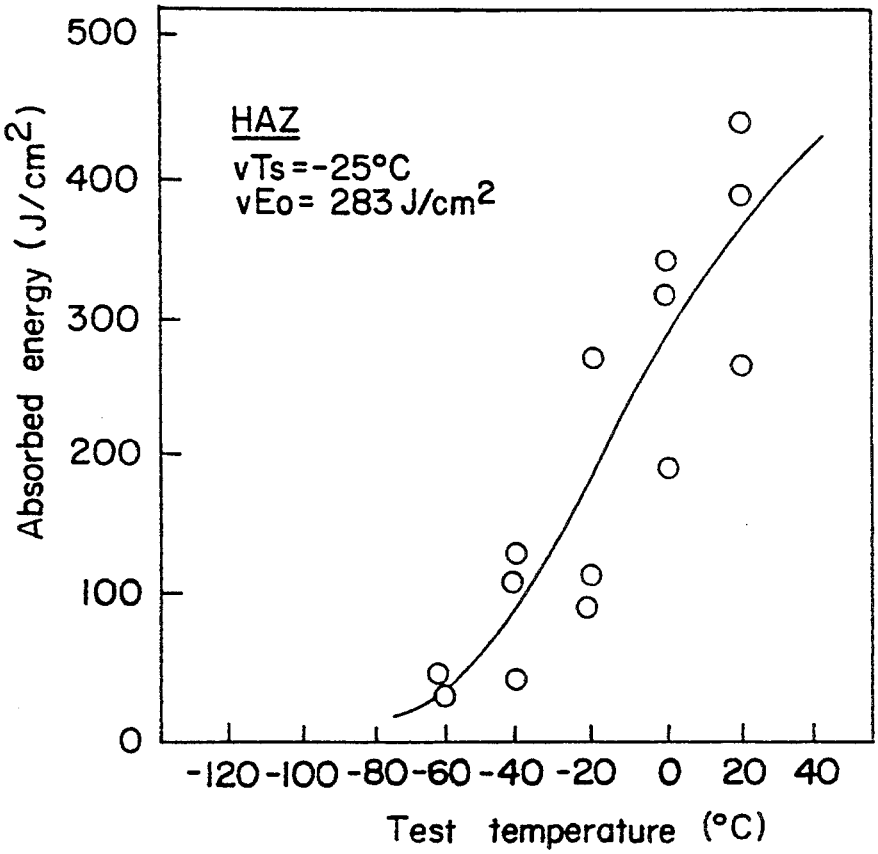

FIG. 4 gives the results of an impact test executed on sample pipes of 250 A×9.5 t made of a steel material having a composition and mechanical properties as given in Table 3, proving that the steel piping of the present invention possesses sufficient strength and toughness.

TABLE 3

| C | Si | Mn | P (%) | S | Cr | Mo |
|---|---|---|---|---|---|---|
| 0.08 | 0.70 | 0.40 | 0.014 | 0.003 | 1.20 | 0.48 |

| Tensile strength ($N/mm^2$) | Yield strength ($N/mm^2$) | Elongation (%) |
|---|---|---|
| 472 | 360 | 43 |

Figure 5:
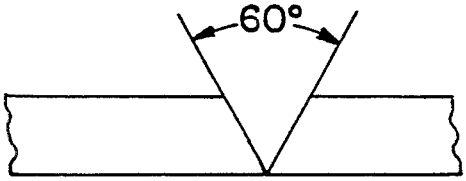
FIG. 5 is an explanatory diagram of the groove for formation of the coupling.

Referring next to the performance of the coupling, all position TIG welding in 3–5 layers was applied to the V-shaped groove of 60° as shown in FIG. 5, omitting the preheating and postheating treatments, under the welding conditions as given in Table 4 below using a TGS-1CML (2.4ϕ welding rod.

TABLE 4

| Current (A) | Voltage (V) | Welding speed (cm/min) |
|---|---|---|
| 120 | 10~12 | 3.5~4.0 |

Table 5 below gives the results of the tensile test of the coupling thus obtained.

TABLE 5

| Test pieces | Tensile strength ($N/mm^2$) | Location of rupture |
|---|---|---|
| 1 | 509 | Base metal |
| 2 | 512 | Base metal |

Figure 6:
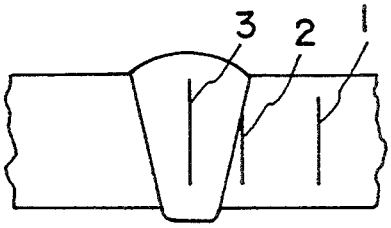
FIG. 6 is an explanatory drawing of the test points of the welding coupling of the present invention.

Table 6 gives the results of impact testing of the coupling section using V-notched 7.5 t×10 w test piece at positions <1> to <3> as indicated in FIG. 6.

TABLE 6

| Notch position | Transition temperature (°C.) | Impact value at 0° C. (J/cm²) |
|---|---|---|
| Base metal | −73 | 441 |
| Heat-affected zone | −25 | 283 |
| Weld metal | −20 | 274 |

FIG. 7 summarizes the coupling section impact test results thus obtained, indicating that both HAZ and weld metal have satisfactory properties.

Figure 8A:
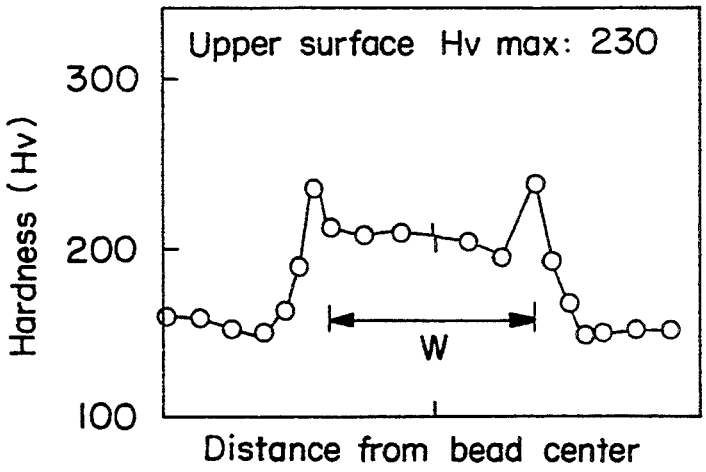
FIG. 8 is a graph indicating a summary of the hardness test results of the welded coupling of the present invention.
Figure 8B:
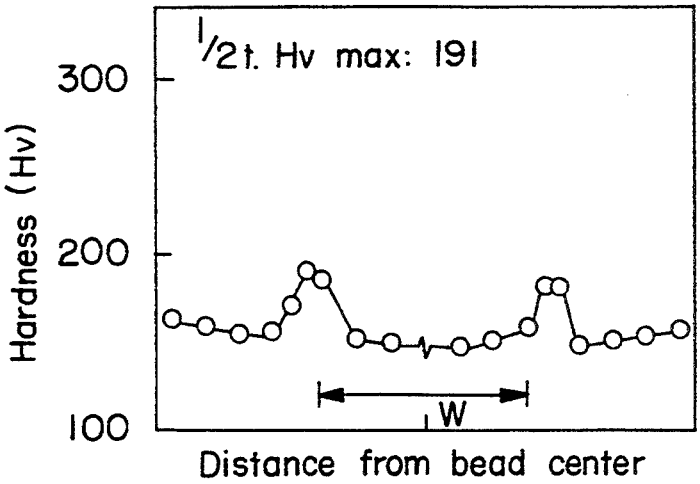
Figure 8C:
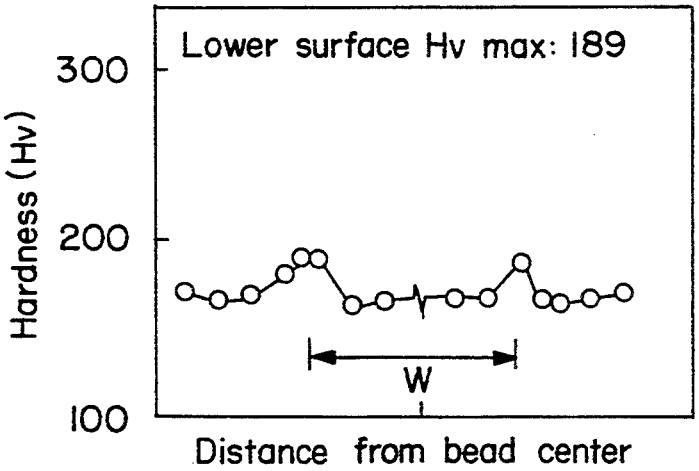

Furthermore, a Vickers hardness test (with a test load of 10 kgf) was executed on the upper surface area (groove side) of the coupling, namely, 2 mm from the upper surface, the center of the thickness (½ t) and the lower surface area (2 mm from the lower surface), with a measuring pitch of 1.0 mm for the base metal and welded sections and 0.5 mm for the heat-affected zone, and the results of the test are given in FIG. 8, indicating satisfactory overall hardness distribution although a small section exists where the hardness exceeds HV200 in the upper surface area.

What is claimed is:

1. A method for welding Cr—Mo steel pipes comprising TIG welding together two steel pipes, without a preheating treatment or a postheating treatment, said steel pipes having a wall thickness of 13 mm or less, said steel pipes consisting essentially of C: 0.03–0.10 wt %, Si: 0.50–1.00 wt %, Mn: 0.30–0.60 wt%, P≦0.020 wt %, S≦0.007 wt %, Cr: 1.00–1.50 wt%, Mo: 0.45–0.65 wt %, Al: 0.002–0.010 wt % and N: 0.002–0.010 wt %, with the remainder being Fe and unavoidable impurities.

2. The method of claim 1, wherein the steel pipes consist essentially of 0.08 wt % C, 0.70 wt % Si, 0.4 wt % Mn, 1.23 wt % Cr, 0.48 wt % Mo, 0.013 wt % P and 0.006 wt % S, with the remainder being Fe and unavoidable impurities.

3. The method of claim 2, wherein the steel pipes have a wall thickness of 12 mm.

4. The method of claim 1, wherein the steel pipes consist essentially of 0.08 wt % C, 0.7 wt % Si, 0.4 wt % Mn, 0.014 wt % P, 0.003 wt % S, 1.2 wt % Cr and 0.48 wt % Mo, with the remainder being Fe and unavoidable impurities.

5. A method for welding a Cr—Mo steel pipe to a Cr—Mo steel pipe coupling comprising TIG welding together a Cr—Mo steel pipe having a thickness of 13 mm or less and a Cr—Mo steel pipe coupling having a thickness of 13 mm or less, without a preheating treatment or postheating treatment, said steel pipe and said steel pipe coupling each consisting essentially of 0.03 to 0.10 wt % C, 0.50 to 1.00 wt % Si, 0.30 to 0.6 wt % Mn, P≦0.20 wt %, S≦0.007 wt %, 1.00 to 1.50 wt % Cr, 0.45 to 0.65 wt % Mo, 0.002 to 0.010 wt % Al, 0.002 to 0.010 wt % N, with the remainder being Fe and unavoidable impurities.

6. The method of claim 5, wherein the steel pipe and the steel pipe coupling each consist essentially of 0.08 wt % C, 0.70 wt % Si, 0.4 wt % Mn, 1.25 wt % Cr, 0.48 wt % Mo, 0.013 wt % P and 0.006 wt % S, with the remainder being Fe and unavoidable impurities.

7. The method of claim 6, wherein the steel pipe has a wall thickness of 12 mm.

8. The method of claim 5 wherein the steel pipe and the steel pipe coupling each consist essentially of 0.08 wt % C, 0.7 wt % Si, 0.4 wt % Mn, 0.014 wt % P, 0.003 wt % S, 1.2 wt% Cr and 0.48 wt % Mo, with the remainder being Fe and unavoidable impurities.

* * * * *